US008132682B1

(12) United States Patent
Chackonal

(10) Patent No.: US 8,132,682 B1
(45) Date of Patent: Mar. 13, 2012

(54) ABSORBENT DEVICE FOR AN INFANT FEEDING BOTTLE

(76) Inventor: Mary Chackonal, Lawrenceville, GA (US)

( * ) Notice: Subject to any disclaimer, the term of this patent is extended or adjusted under 35 U.S.C. 154(b) by 113 days.

(21) Appl. No.: 12/386,312

(22) Filed: Apr. 16, 2009

(51) Int. Cl.
*A61J 9/08* (2006.01)

(52) U.S. Cl. ..... 215/11.6; 215/386; 215/392

(58) Field of Classification Search ..... 215/11.6, 215/12.1, 386, 392, 394; 220/903, 571, 738, 220/DIG. 5; D3/202; D7/624.2, 625; D9/444; D24/199; 222/108; 248/102
See application file for complete search history.

(56) References Cited

U.S. PATENT DOCUMENTS

| | | | | | |
|---|---|---|---|---|---|
| 1,669,061 | A | * | 5/1928 | Meltzer | 215/11.6 |
| 2,035,384 | A | * | 3/1936 | Hinchliff | 66/170 |
| 2,409,820 | A | * | 10/1946 | Zimmern | 215/12.1 |
| 2,809,760 | A | * | 10/1957 | Clark | 215/11.6 |
| 4,526,280 | A | * | 7/1985 | Taylor | 215/395 |
| 4,934,542 | A | * | 6/1990 | Clark, Jr. | 215/11.1 |
| D340,991 | S | * | 11/1993 | Clements | D24/199 |
| 5,312,282 | A | | 5/1994 | Cooper | |
| D378,195 | S | * | 2/1997 | Bird | D7/624.2 |
| D382,800 | S | * | 8/1997 | Dedering | D9/434 |
| D391,483 | S | | 3/1998 | Freeman | |
| H1738 | H | * | 7/1998 | Reinhart, Jr. | 2/49.1 |
| 5,898,940 | A | | 5/1999 | Cameron | |
| 5,957,692 | A | * | 9/1999 | McCracken et al. | 434/159 |
| 6,442,759 | B1 | | 9/2002 | Straham, Jr. et al. | |
| 6,585,711 | B1 | | 7/2003 | Lohrasbi | |
| 6,612,452 | B2 | | 9/2003 | Heilner | |
| 6,640,825 | B2 | * | 11/2003 | McAtarian | 137/312 |
| 6,732,375 | B2 | | 5/2004 | Nornes | |
| 6,745,913 | B2 | * | 6/2004 | Abraham | 215/11.6 |
| 6,749,082 | B1 | * | 6/2004 | Nickel | 220/738 |
| 6,772,891 | B1 | * | 8/2004 | Song | 215/11.6 |
| 6,859,938 | B1 | | 3/2005 | Niski et al. | |
| 6,955,272 | B2 | | 10/2005 | Collins | |
| 7,032,248 | B1 | | 4/2006 | Gutilla | |
| 7,614,523 | B1 | * | 11/2009 | Fixler et al. | 220/738 |
| 2005/0210558 | A1 | | 9/2005 | Cannon | |
| 2006/0278598 | A1 | * | 12/2006 | Song | 215/11.6 |

* cited by examiner

*Primary Examiner* — Sue Weaver
(74) *Attorney, Agent, or Firm* — Montgomery Patent & Design, LLC; Robert C. Montgomery; Joseph T. Yaksich

(57) ABSTRACT

An attachable absorbent cloth cover for an infant feeding bottle is herein disclosed, comprising a rectangular shape approximately ten (10) inches in length. The middle portion of the cloth body is fitted with an elastic band. The cloth cover is slipped over a bottle such that the elastic band firmly grips the lid of the bottle at the base of the nipple. As such, it is not necessary for the infant to wear a bib, as any spilled liquid is immediately absorbed since the cloth is right below the infant's lower lip and chin. The cloth cover is envisioned to be made of soft, absorbent material similar to that used for re-usable diapers and is provided with an internal wire frame to support a desired position while in use and external raised graphic designs to sooth the baby. When finished, the cloth cover is simply lifted off and machine washed, thus ready for use again.

14 Claims, 4 Drawing Sheets

ABSORBENT DEVICE FOR AN INFANT FEEDING BOTTLE

RELATED APPLICATIONS

The present invention was first described in a notarized Official Record of Invention on Jan. 29, 2008, that is on file at the offices of Montgomery Patent and Design, LLC, the entire disclosures of which are incorporated herein by reference.

FIELD OF THE INVENTION

The present invention relates generally to covers for bottles and, more particularly, to an exterior protective covering for a glass baby nursing bottle.

BACKGROUND OF THE INVENTION

Caring and feeding for an infant can be one (1) of the most rewarding things that we as humans do. It in itself is a simple act, but can form bonds between child and adult that will last a lifetime. Unfortunately, it can also be one of the messiest, especially during the bottle feeding period of a child life. Any formula or milk that leaks out is sure to run down the child's face. Bibs are often used in an attempt to catch and absorb this mess and keep the child, the caregiver, and the surroundings clean. The problem exists that it is more likely that the mess will run down the infant's neck, get their clothing wet and stained, and even get the clothing of the person feeding them dirty as well. Even if the bib does its job effectively, it takes time to put on, annoys the infant, irritates their skin, and becomes wet as well.

Various attempts have been made in the past to overcome these disadvantages and provide a baby nursing bottle having a means of exterior protection without the aforementioned problems. Among the relevant attempts to address these problems are several U.S. Pat. No. 6,442,759; 6,585,711; 6,732,375; and 7,032,248.

U.S. Pat. No. 5,312,282, issued in the name of Cooper, describes a baby bottle and bib structure which takes the form a doll comprising nursing bottle structure, a removable cover is snapped about the nipple portion forming the head of the doll, and an attached bib structure. The bib portion provides a support means to the baby bottle about the neck of the infant.

U.S. Pat. No. 5,898,940, issued in the name of Cameron, describes a combined bib and bottle holder comprising a front and rear panel which is sewn together and encloses a soft material, an elastic loop which is attached to the front panel which provides a means of supporting a baby bottle, and a neck hole.

U.S. Pat. No. 6,955,272, issued in the name of Collins, describes a baby bottle bib that slides onto a bottle comprising a bottle-sized hole located toward one (1) side of the bib body and an elastic collar which provides a means of protecting against spills or spit-up while drinking.

Additionally, ornamental designs for nursing bottle bibs and aprons exist, particularly, U.S. Pat. No. D 391,483. However, none of these designs are similar to the present invention.

While these devices fulfill their respective, particular objectives, each of these references suffers from one or more of the aforementioned disadvantages. Accordingly, there exists a need for a means by which infants who are feeding from a bottle can be protected from spills and leaks without the inefficiencies and discomfort of a bib. The development of the present invention fulfills this need.

SUMMARY OF THE INVENTION

In view of the foregoing references, the inventor recognized the aforementioned inherent problems and observed that there is a need for an absorbent device for a baby bottle and thus, the object of the present invention is to solve the aforementioned disadvantages.

To achieve the above objectives, it is an object of the present invention to provide an absorbent device for baby bottles which provides a cloth cover for an infant feeding bottle which eliminates the necessity for a bib comprising a cover and a centrally located aperture which is simply slipped over a lid opening of the baby bottle to absorb any spilled milk or formula and spit-up as a baby feeds.

Another object of the present device is to provide a device comprising a cover, a center aperture located at a middle region of the cover; and an elastic band located around the center aperture and provides a means to grip around a base of the lid of the baby bottle such that a nipple retainer portion and a nipple protrude above the cover.

Yet still another object of the present device is to provide a device comprising an integral stiffener comprising a sewn-in wire matrix of rows and columns of reinforcing plastic coated metal wires.

Yet still another objective of the present device is to provide the stiffener which enables the device to be shaped by a user into a particular form, thereby conforming to a baby's lower chin and upper neck features.

Yet still another object of the present device is to provide a device comprising an absorbent cloth-like material having various shapes which simulate articles such as a dog bone and various decorative exterior graphics.

Yet still another object of the present device is to provide a method of utilizing the absorbent device for s baby bottle which provides the protection and cleanliness of a bib without the time, mess, or aggravation.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
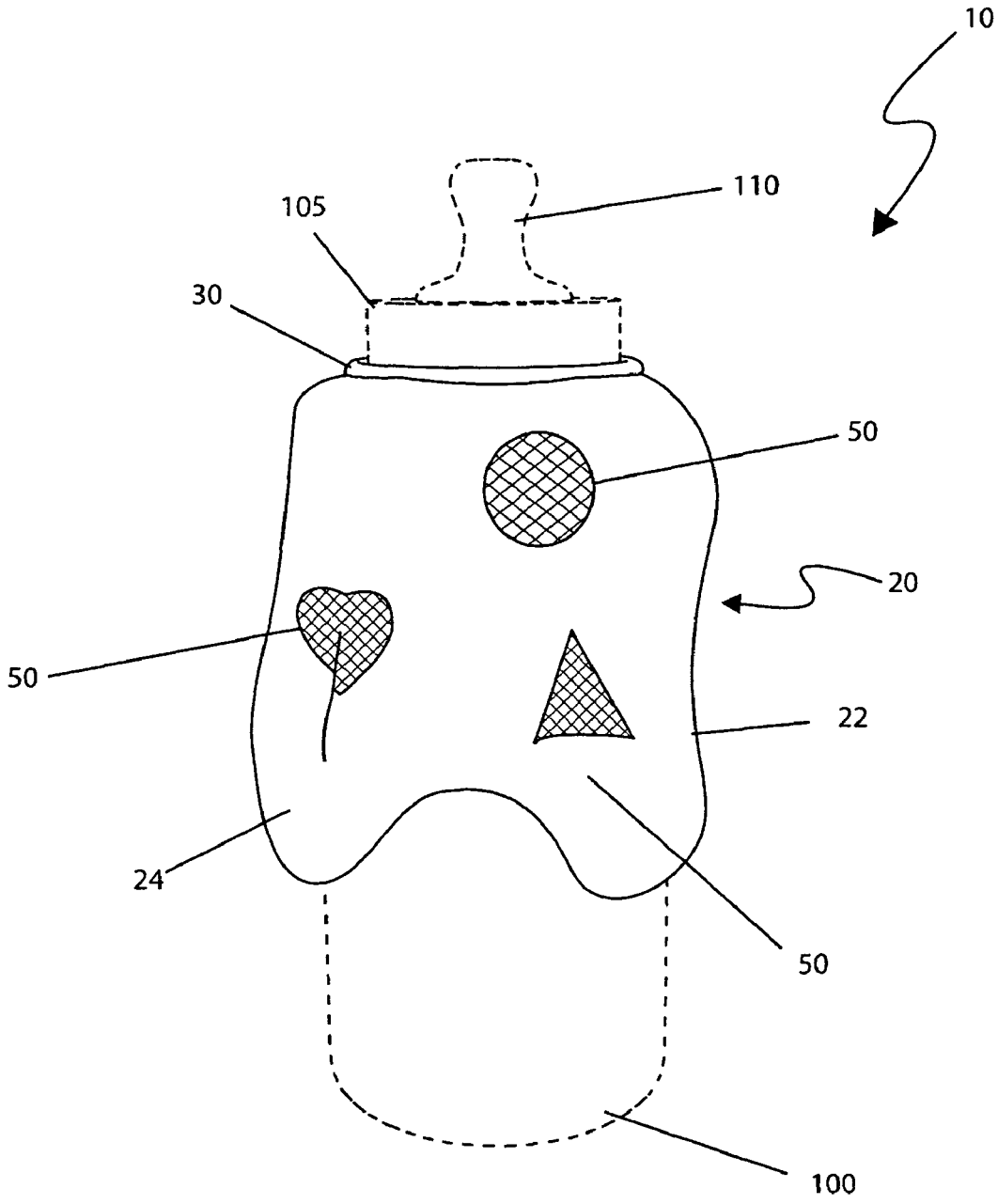
FIG. 1 is an environmental view of an absorbent device for baby bottles 10, according to a preferred embodiment of the present invention.

10 absorbent device for baby bottles
20 body assembly
22 body wall portion
24 first side
26 second side

28 stiffener
30 elastic band
32 center aperture
50 graphic
100 baby bottle
105 nipple retainer
110 nipple

DETAILED DESCRIPTION OF THE PREFERRED EMBODIMENT

The best mode for carrying out the invention is presented in terms of its preferred embodiment, herein depicted within the FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an absorbent device for baby bottles (herein described as the "device") 10, which provides a cloth cover for an infant feeding bottle 100 intended to eliminate the necessity for a bib. The device 10 comprises a shape simulating a dog bone having a first side 24 and a second side 26 and is simply slipped over a lid opening of the baby bottle 100 to absorb any spilled milk or formula and spit-up as the baby feeds.

Referring now to FIG. 1, an environmental view of the device 10, according to the preferred embodiment of the present invention, is disclosed. The device 10 comprises a rectangular or bone-shaped body assembly 20 and an elastic center aperture 30. The body assembly 20 provides an absorbent cloth cover for a baby feeding bottle 100 intended to eliminate the necessity for a bib. The body assembly 20 comprises a body wall portion 22 approximately two (2) inches in width near the center, six (6) inches in width at an end, and ten (10) inches in length. The body wall portion 22 comprises a first side 24 and second side 26. The device 10 further comprises an elastic band 30 and center aperture 32 located thereat a middle region. The device 10 is slipped thereover an upper end opening of the baby bottle 100 such that said elastic band 30 firmly grips therearound the base of a lid below a nipple retainer portion 105 and a nipple 110 which both protrude therethrough the center aperture 32. The body assembly 20 comprises soft, absorbent, and machine washable fabric materials similar to those used for re-usable diapers. The body wall portion 22 is constructed using a sewn lamination of natural and synthetic textile materials common in the industry. The device 10 further comprises a plurality of exterior graphics 50 which protrude slightly above exterior surfaces of the body wall portion 22. The graphics 50 are designed to provide visual stimuli as well as a comforting touching surface for the baby during feeding. The graphics 50 provide soft, rounded, and textured shapes such as, but not limited to: circles, stars, flowers, animal figures, and the like which are affixed thereto the exterior surface of the body wall portion 22 using sewing, adhesive bonding, or the like. The exterior surfaces of both the body wall portion 22 and the graphics 50 are envisioned to be introduced in a variety of attractive matching or contrasting colors and patterns based upon a user's preference.

Figure 2:
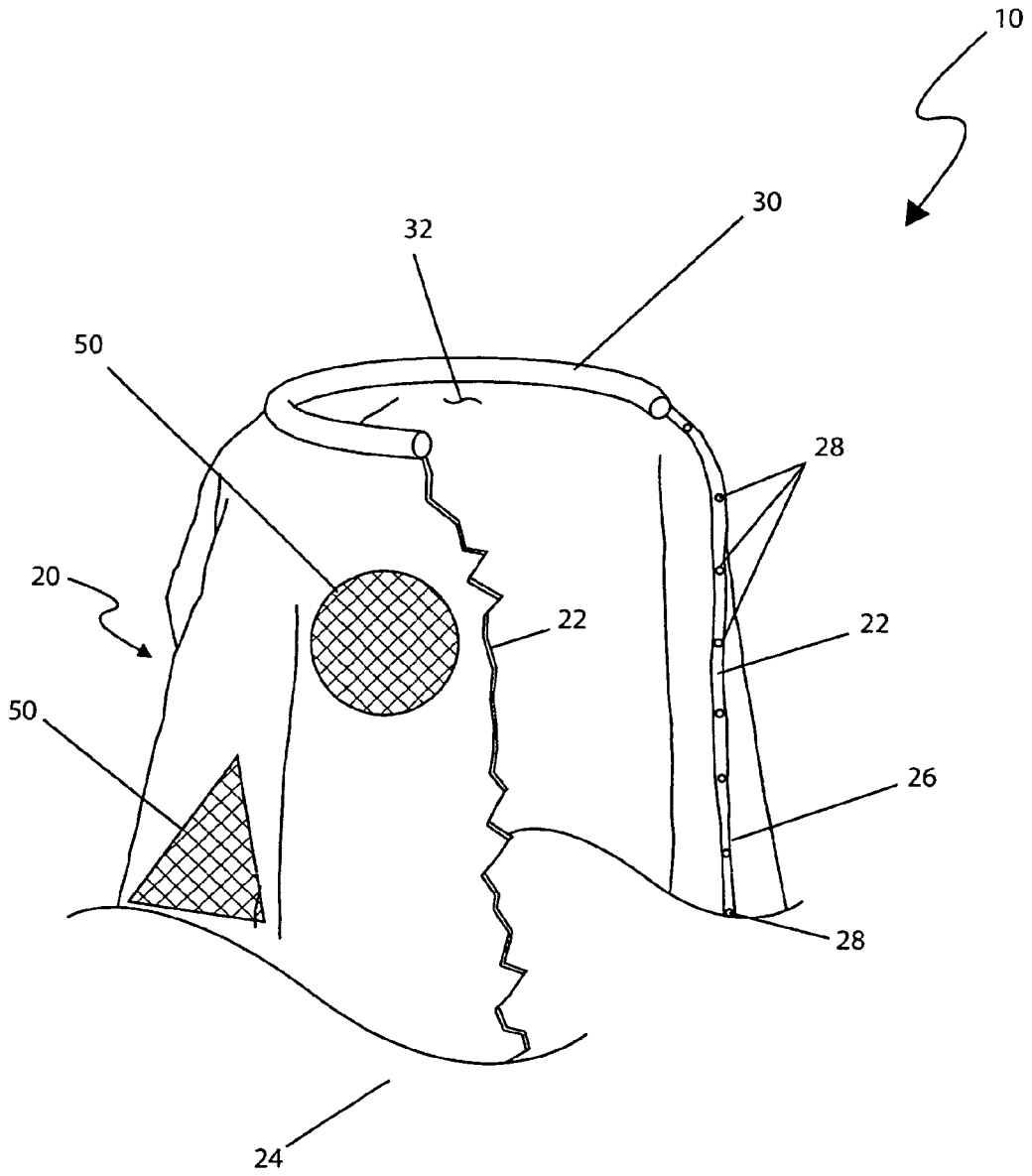
FIG. 2 is a cut-away view of an absorbent device for baby bottles 10, according to a preferred embodiment of the present invention.
Figure 3:
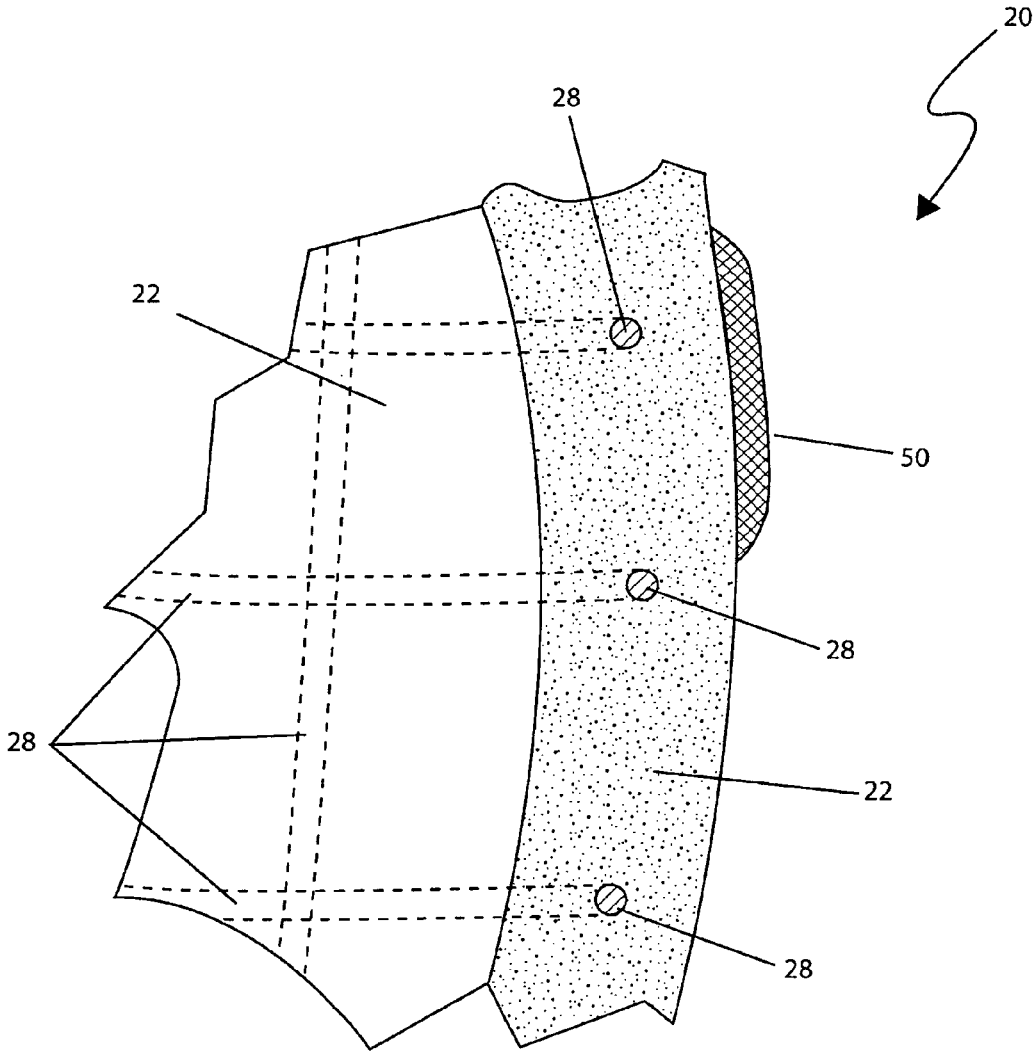
FIG. 3 is a section view of a body wall portion 22 of an absorbent device for baby bottles 10, according to a preferred embodiment of the present invention; and, FIG. 4 is a flattened top view of an absorbent device for baby bottles 10, according to a preferred embodiment of the present invention.

Referring now to FIGS. 2 and 3, cut-away view of the device 10 and a section view of the body wall portion 20, according to the preferred embodiment of the present invention, are disclosed. The elastic band 30 provides an elastic collapsing feature thereto the center aperture 32 of the device 10 which provides for a firm grip therearound the threaded lid portion of the baby bottle 100. The device 10 may also be utilized as a protective cover by lifting the center aperture 32 above the nipple 110, thereby allowing the elastic band 30 to collapse thereto a relatively closed state, thus enclosing the nipple end 110 of the bottle 100. The center aperture 32 comprises a sewn-in annular elastic band 30 which is made of rubber, latex, or the like which is capable of extending therefrom a completely closed state thereto an open state approximately two (2) inches in diameter. The body wall portion 22 further comprises a sewn-in wire matrix reinforcing stiffener 28 (see FIG. 3) which provides some stiffness and support thereto said body wall portion 22 during use. Thus, said stiffeners 28 enable the device 10 to be shaped by a user thereinto a particular form so as to conform thereto the baby's lower chin and upper neck features, thereby wicking away spilled milk and formula therefrom the babies face and neck as the infant feeds. The stiffeners 28 comprise rows and columns of thin plastic coated metal wires being similar to twist-ties forming a crisscrossing pattern. The stiffeners 28 cross one another at right angles to form a matrix of squares being approximately one-half (½) of an inch across.

Figure 4:
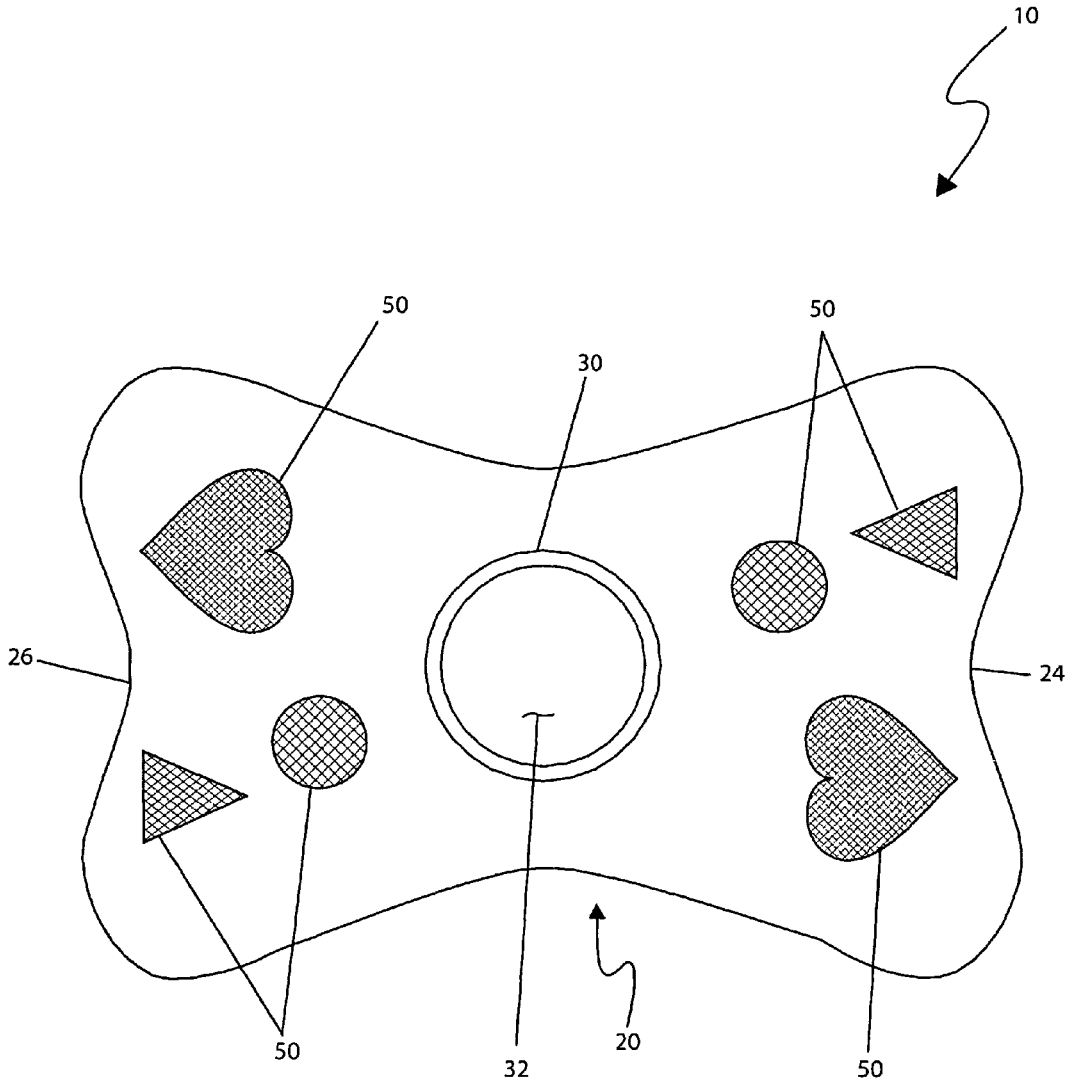

Referring to FIG. 4, a flattened top view of the device 10, according to the preferred embodiment of the present invention, is disclosed. The device 10 comprises a bone-shape with each side 24, 26 further comprising a contoured distal end. These contoured ends give the device 10 the appearance of an exaggerated bone with the center aperture 32 therein the middle. The device 10 is placed thereon the baby bottle 100 and positioned thereat the base of the nipple retainer 105 during the feeding process. When the bottle 100 is in use and upright the contoured end of the first side 24 or the second side 26 may be tucked thereunder the lip or chin of the feeding baby, thus the absorbent body wall 22 absorbs any spilt milk or formula and prevents a mess.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be utilized as indicated in FIG. 1.

The method of utilizing the device 10 may be achieved by performing the following steps: preparing a bottle 100 of milk or formula in a normal manner; slipping said device 10 thereover the bottle 100; expanding the elastic band 30 and positioning the center aperture 32 therearound the base portion of the lid thereunder the nipple retainer 105; shaping the body wall portion 22 as needed to assure effective wicking of any spilt milk or formula therefrom the baby's lips and/or cheek and chin area thereto said body wall portion 22; feeding the baby in a normal fashion; encouraging the baby to touch the graphic shapes 50, thereby soothing and entertaining the baby during feeding; sliding said center aperture 32 thereabove the nipple 110 thus allowing said center aperture 32 to take on a closed state providing enclosed protection thereto said nipple 110 from dropping or possible contamination; slipping said device 10 upwardly therefrom said bottle 100 and machine washing said device 10 in a normal manner; reusing said device 10 for subsequent feedings as needed; and, benefiting therefrom an improved feeding experience by a baby and caregiver alike, using the present device 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An absorbent device for a baby bottle, comprising:

a cover slipped over a lid opening of said baby bottle, thereby absorbing any spilled material during a baby feeding time, said cover comprising a center aperture located at a middle region of said cover; and, an elastic band located around an entire circumference of said center aperture at said middle region of said cover;

wherein said cover further comprises a body wall portion;

wherein a nipple retainer portion and a nipple of said baby bottle protrude therethrough said center aperture of said cover;

wherein said body wall portion comprises a stiffener, thereby providing support thereto said body wall portion during use;

wherein said stiffener comprises a sewn-in wire matrix reinforcing stiffener comprising rows and columns of plastic coated metal wires; and, wherein said stiffener is arranged in a criss-cross pattern and located within said body wall portion.

2. The device of claim 1, wherein said cover comprises a cloth material.

3. The device of claim 1, wherein said cover comprises a dog bone shape.

4. The device of claim 1, wherein said cover comprises a rectangular shape.

5. The device of claim 1, wherein said a body wall portion is further approximately two (2) inches in width near a center area, approximately six (6) inches in width at an end area, and approximately ten (10) inches in length.

6. The device of claim 5, wherein said body wall portion is constructed using a sewn lamination of textile materials.

7. The device of claim 1, wherein said stiffener enables said device to be shaped by a user into a particular form, thereby conforming thereto a baby's lower chin and upper neck features.

8. The device of claim 1, wherein said stiffener forms a matrix of squares comprising a width of approximately one-half (½) inch across.

9. The device of claim 1, wherein said cover comprises an absorbent material.

10. The device of claim 1, wherein said cover comprises a machine washable material.

11. The device of claim 1, wherein said device comprises a plurality of exterior graphics.

12. The device of claim 11, wherein said plurality of exterior graphics protrude slightly above exterior surfaces of said cover, thereby providing a touching surface for the baby during feeding.

13. The device of claim 11, wherein said plurality of exterior graphics is affixed thereto an exterior surface of said cover using sewing or adhesive bonding.

14. The device of claim 1, wherein said elastic band comprises a rubber or latex material.

* * * * *